US005095573A

United States Patent [19]

Henke et al.

[11] Patent Number: 5,095,573

[45] Date of Patent: Mar. 17, 1992

[54] SCRAPER TOOL

[75] Inventors: David R. Henke, Maple Grove; Douglas B. Malchow, St. Louis Park, both of Minn.

[73] Assignee: Warner Manufacturing Company, Minneapolis, Minn.

[21] Appl. No.: 590,502

[22] Filed: Sep. 26, 1990

Related U.S. Application Data

[63] Continuation of Ser. No. 312,352, Feb. 15, 1989, abandoned, which is a continuation of Ser. No. 70,974, Jul. 8, 1987, abandoned.

[51] Int. Cl.[5] ..... A47L 13/02

[52] U.S. Cl. ..... 15/105; 15/236.01; 15/236.05; 15/236.07; 30/169; 30/172; 294/55; D30/162; D32/49

[58] Field of Search ..... 30/136, 136.5, 164.8, 30/169, 171, 172; 294/1.3, 7, 54.5, 55, 49, 51, 131; 15/105, 111, 236.01, 236.03, 257.1, 257.2, 257.9; D7/691; D30/162; D32/74, 46, 49

[56] References Cited

U.S. PATENT DOCUMENTS

| | | | |
|---|---|---|---|
| D. 100,390 | 7/1936 | Robison, Jr. | 30/169 X |
| 691,861 | 1/1902 | Hemstrom | 30/169 X |
| 929,194 | 7/1909 | Compton | 30/169 |
| 960,624 | 6/1910 | Compton | 15/105 |
| 2,860,858 | 11/1958 | Kurs | 30/169 X |

FOREIGN PATENT DOCUMENTS

| | | | |
|---|---|---|---|
| 183150 | 9/1955 | Austria | 30/171 |
| 361534 | 10/1922 | Fed. Rep. of Germany | 15/257.1 |
| 180904 | 2/1936 | Switzerland | 15/257.1 |
| 2151531 | 7/1985 | United Kingdom | 15/236.01 |
| 2155744 | 10/1985 | United Kingdom | 294/1.3 |

*Primary Examiner*—Philip R. Coe
*Assistant Examiner*—C. Cooley
*Attorney, Agent, or Firm*—Merchant, Gould, Smith, Edell, Welter & Schmidt

[57] ABSTRACT

A paint scraper tool includes a blade member and a handle member extending at an angle thereto. The blade member has an upper and a lower surface, and the tool includes side gusset members mounted on the blade member upper side. The handle member extends at an acute angle rearwardly from the blade member and toward the blade member upper side. The tool includes a beveled front edge thereon, for ease of scraping, the beveled edge having awl points therein to facilitate scraping of cracks, crevices, corners and the like. The tool also includes curved blade surfaces, for use in scraping rounded surfaces such as furniture legs. For the preferred embodiment, the side gusset members and tool handle cooperate to provide a particularly advantageous system. Further, the gusset members form sides of a trough in which paint scrapings may be received, during use of the tool. Preferably the tool is formed from a single piece of molded plastic material or the like.

8 Claims, 1 Drawing Sheet

FIG. 1
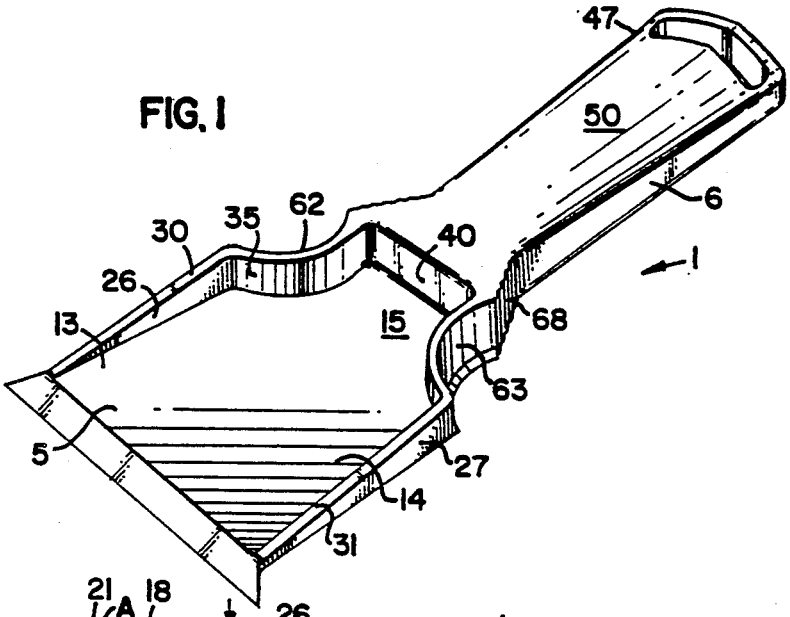
FIG. 2
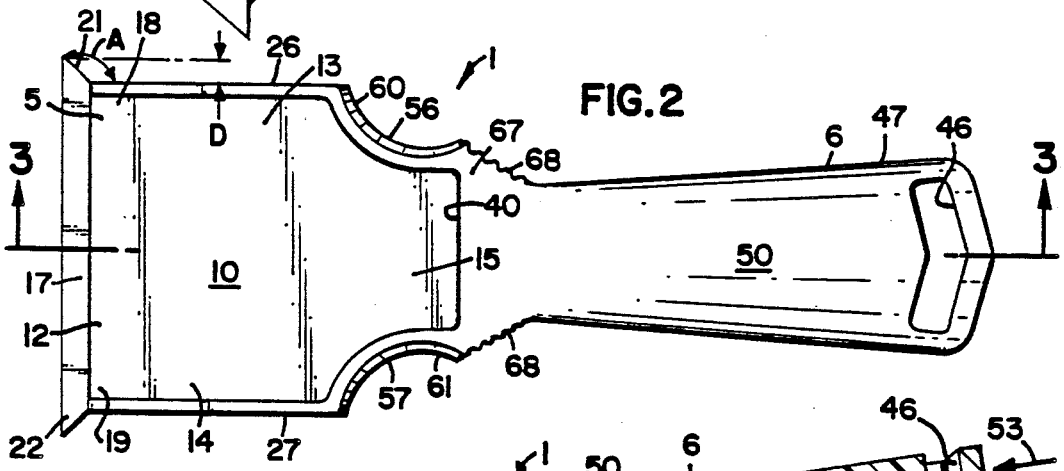
FIG. 3
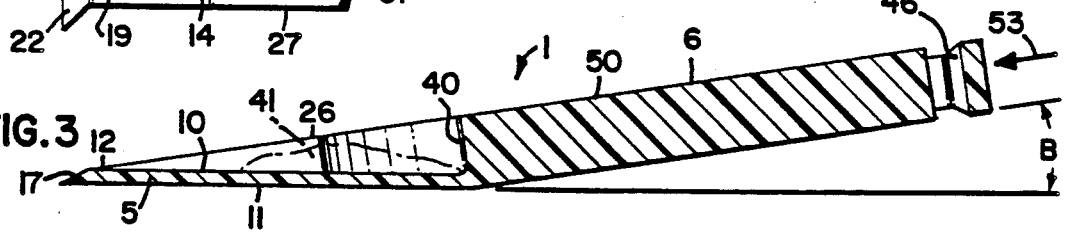
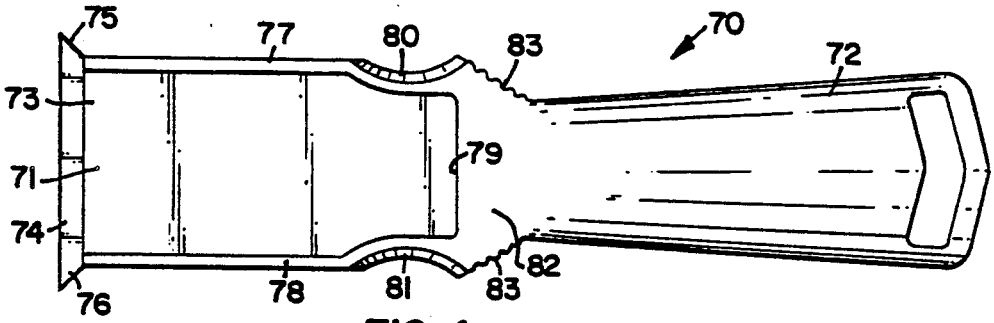
FIG. 4

SCRAPER TOOL

This is a continuation, of application Ser. No. 07/312,352, filed Feb. 15, 1989, now abandoned which is a continuation of Ser. No. 07/070,974, filed July 8, 1987, now abandoned.

FIELD OF THE INVENTION

The present invention relates to tools, in particular tools for use in removing paint from painted surfaces. Specifically, the invention concerns a tool particularly well suited for use in association with a chemical paint stripper.

BACKGROUND OF THE INVENTION

Paint stripping is generally accomplished through one of three methods: simple scraping; the utilization of a heat gun in association with a scraper, typically referred to as a "burn off" scraper; or, the use of a chemical agent in combination with a scraping or lifting tool. The scraper generally comprises a blade attached to a handle. During a paint scraping operation, the blade is pushed underneath the paint, stripping same from the painted surface. The paint may be rendered loose and pliable so as to form a sludge by chemical means or the like.

A wide variety of scrapers are known. A typical conventional scraper comprises a flat, spatula-shaped blade mounted on a plastic or wooden handle. In some instances, the blade has a beveled, i.e., knife-like, forward edge to facilitate scraping. Typically, the blade is made from metal such as stainless steel.

A problem with this type of conventional scraper is that the relatively thin, flat, blades are often flexible, especially if metal, and bend during use. This flexing or bending may not only make scraping difficult, but if excessive it may also render the tool permanently damaged. If a flat, non-bendable, material is used, the blade may fracture rather than flex.

A wide variety of shapes of blades are well known in the art. Some blades include portions to enable easy access to corners, painted cracks and painted crevices.

The better known and most common blade-type scrapers generally have a handle which is substantially coplanar with the blade. Thus, this scraper has first and second sides, which are generally mirror images of one another and which are substantially identical.

In other arrangements the handle is angled relative to the blade. An advantage obtained from these arrangements is that the blade may be readily used with the handle bent outwardly from the surface being stripped, so that a worker's fingers can be wrapped around the handle and fit between the handle and the surface being worked on. A disadvantage in many such systems is that the angled handle tends to exacerbate the problem of blade bending. That is, force directed along the handle is asymmetric, with respect to the plane of the blade, encouraging undesired blade bending.

Another problem with many conventional scraper blades is that they contain no means for collection or deflection of scraped paint or sludge and the scraped material might be directed onto the worker's hands. This is not only potentially messy, but the paint sludge may also be harmful if it has been formed from chemical removed of the paint. This can lead to a substantial risk of irritating a worker's hand.

Many conventional scrapers only have a single, long, straight, scraping blade. Such blades are not well suited for scraping paint from curved surfaces such as furniture legs and railings. Thus with such arrangements more than one scraping tool may be needed.

What has been needed has been a versatile scraping tool which contains a reinforced scraping blade and which is not generally subject to the problems previously detailed.

OBJECTS OF THE INVENTION

Therefore, the objects of this invention are: to provide a versatile scraping tool for use in the removal of paint or the like from painted or varnished surfaces; to provide such a tool comprising a scraping blade member attached to a handle member; to provide a preferred such arrangement wherein the blade and handle are integral, having been formed from a single piece of molded plastic material or the like to substantially eliminate any step of assembly; to provide such an arrangement wherein the blade member is reinforced against flexing by means of gusset members attached thereto; to provide such a tool wherein the handle member extends at an angle with respect to the blade; to provide such a tool wherein the gusset members, in association with a wall member, form a trough for the receipt of paint scrapings or sludge therein; to provide a preferred such arrangement wherein force longitudinally applied to the handle is partially directed toward the front edge of the blade, by transmission through the gusset members; to provide a preferred such arrangement wherein upper surfaces of the gusset members are coplanar with an upper surface of the handle member, so that the scraper tool may be laid flat upon a flat surface and so that use without substantial likelihood of bending the blade member is facilitated; to provide a preferred such arrangement wherein the blade member has a front, beveled, blade edge; to provide a preferred such arrangement wherein the preferred blade member includes awl or pick points thereon, for use in cleaning cracks, crevices, corners, wall joints and the like; to provide such an arrangement wherein the preferred tool includes a curved scraper blade portion therein; to provide such a preferred tool wherein the curved scraper blade has a beveled knife blade portion; to provide such an arrangement wherein the preferred tool includes a transition portion between the handle and the gusset members, having friction ribs thereon to facilitate gripping; and, to provide such a scraper tool which is relatively inexpensive and simple to produce, which is relatively easy to use and which is particularly well adapted for the proposed usages thereof.

Other objects and advantages of this invention will become apparent from the following descriptions, taken in conjunction with the accompanying drawings, wherein are set forth, by way of illustration and example, various embodiments of the invention.

SUMMARY OF THE INVENTION

A scraper tool is provided for use in removing paint or the like from a painted or coated surface. The preferred tool is particularly versatile, and may be used to remove paint from either flat or curved surfaces. Further, it may be effectively used to remove paint from corners, cracks, crevices, joints or the like. Generally, the scraper tool is intended for use in association with chemical paint removers or the like; the chemical remover being used to loosen the paint to form a sludge, and the tool being applied in a generally conventional manner to lift the paint sludge from the painted surface. In some instances the tool might be used to scrape loose paint or the like which has not been chemically treated. A tool having features of the present invention may even in some instances be used with a heat gun if the tool is manufactured from suitable heat resistant materials.

Numerous advantages result from the scraper tool's unique construction. The preferred tool is molded from a polymeric plastic material or the like, suitably strong for use without substantial likelihood of breakage. Many such plastic materials are well known. Advantages result from such construction, i.e., ease of manufacture and relatively low expense. Molding from a single piece of plastic is in part facilitated by the unique arrangement, which generates a reinforced blade member. Generally, unreinforced plastic blades would be likely to break during use. When metal is used for the blade, manufacturing costs are increased due to raw material costs and the need for an assembly step (attachment of metal blade to non-metallic handle). Another advantage to plastic is that it is relatively soft and thus will be less likely to damage or scratch wood surfaces be scraped. Also, it is chemically resistant and does not substantially deteriorate or rust.

The preferred paint scraper according to the present invention comprises a blade member, first and second side gusset members, a rear wall member and a handle member. The blade member has upper and lower surfaces, a front edge, first and second opposite side edges, and a rear portion. The front edge of the blade member preferably comprises the knife blade edge which during use is forced underneath paint, or paint sludge, to scrape same from the painted surface. The preferred blade member front edge is beveled to a relatively sharp edge.

The blade member front edge of the preferred embodiment extends between two front corners of the blade member. Preferably, the blade member has pick or awl points or members formed at each of these corners. The pick members or awl points may be used to scrape paint from relatively tight corners or along cracks, crevices or wall joints. Further, they are useful for scraping delicate and intricate woodwork.

The blade member includes first and second side edges. One each of the gusset members extends generally along one each of the blade member's side edges. The gusset members reinforce the blade member, to inhibit bending and possible breakage. Thus, the gusset members enable a useful arrangement which may be manufactured from plastic. Further, the gusset members form sides of a trough, which may be used to receive, collect and/or deflect cracked and/or scraped paint or paint sludge.

The preferred scraper tool includes a rear wall member extending between the gusset members, to complete formation of the three-sided trough. The rear wall member forms an abutment against which scraped paint can collect or which can deflect chipped or scraped paint. The rear wall member will help protect a worker's hand from the paint scrapings or sludge.

The handle member is attached to a blade member at the rear portion thereof. Generally, the handle member extends rearwardly from the rear wall member. In the preferred embodiment, the handle member extends at an angle relative to the blade member, and most preferably is angled toward the same side of the blade member as are positioned the gusset members and rear wall member. Preferably, the handle member extends at an acute angle with respect to the blade member, the preferred acute angle being between about 5 and 12 degrees, and preferably between about 8 and 9 degrees. The preferred handle is tapererd (side-to-side) for a comfortable grip, and is relatively thick throughout (both top-to-bottom and side-to-side) for a comfortable grip. At its widest (side-to-side) the preferred handle is about $1\frac{1}{4}$–$1\frac{1}{2}$ inches wide, tapering down to about $\frac{7}{8}$ to $1\frac{1}{8}$" wide. A preferred thickness for a comfortable handle is about $\frac{3}{8}$ to $\frac{5}{8}$" thick. It will be understood, however, that many of the principles of the present invention can be applied to tools having handles of a variety of dimensions.

The preferred scraper tool also includes curved scraper blades thereon. In the preferred embodiment, first and second convex scraper blades are positioned substantially adjacent to the rear wall member and at opposite sides of the blade member, facing outwardly. The curved blade members may be used to scrape paint from curved surfaces such as railings or posts. The preferred curved scraper blades have tapered or beveled edges, to facilitate scraping or the preferred embodiment the gusset members cooperate with the curved blade members to provide a recess or trough to facilitate paint scraping and collection.

For the preferred embodiment, the handle member is attached to the blade member through a transition portion. The transition portion preferably includes friction ribs thereon to facilitate gripping. For the preferred embodiment the ribs are vertical. The friction ribs help prevent the worker's hands from sliding with respect to the scraper tool during use.

For the preferred embodiment, an upper surface of the handle member is coplanar with upper ridges of the gusset members. Several substantial advantages result from this arrangement. First, the tool, as a result, can be laid flat upon a table, workbench, or be hung on a hook to rest flat against a wall or upright member. Thus, the tool is relatively stable when laid down or stored, and does not create an extended or projecting blade edge which can be inconvenient or even hazardous under some circumstances.

Further, the handle member, in conjunction with the gusset members, directs longitudinal force supplied to the handle member by the worker in a preferred manner. Specifically, some force being transmitted toward the front blade edge will be directed through the gusset members. Without the gusset members, this component of force would be substantially less prevalent, and more of a force would be directed to, and through the flat blade of the blade member. As a result, the blade member would be more susceptible to bending and less force could effectively be concentrated and directed to the blade's front edge. Further, the blade might be more difficult to move along a wall surface or similar painted surface, since pressure into the wall would likely be greater, causing greater friction.

As indicated previously, the preferred tool is reinforced such that it can be manufactured as a single piece of molded plastic. This not only results in an advantageous tool at a lower cost, but other advantages may result. For example, plastic is more chemically resistant and is not susceptable to rust.

The drawings constitute a part of the specification and include preferred embodiments of the present invention, while illustrating various objects and features thereof. In some of the figures, relative material thicknesses may be shown exaggerated to facilitate an understanding of the invention.

BRIEF DESCRIPTION OF THE DRAWINGS

FIG. 1 is a perspective view of a scraper tool according to the present invention.

FIG. 2 is a top plan view of the scraper tool shown in FIG. 1.

FIG. 3 is a side cross-sectional view taken generally along line 3—3 of FIG. 2.

FIG. 4 is a top plan view of an alternate embodiment of the scraper tool, according to the present invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but rather as a basis for the claims and as a representative basis for teaching one skilled in the art to variously employ the present invention in virtually any appropriately detailed structure.

The reference numeral 1, FIG. 1, generally designates a paint scraper tool according to the present invention. The tool 1 includes a blade member 5 and a handle member 6. In use, a worker grips the handle member 6 to push the blade member 5 underneath the paint or paint sludge to be stripped or scraped.

Referring to FIGS. 2 and 3, the blade member 5 is preferably planar and has an upper surface 10, a lower surface 11, a front edge 12, first and second opposite side edges 13 and 14, and a rear portion 15. The terms "upper", "lower", "front", "rear" and "side", and similar terms, are intended only to refer to a typical tool 1 according to the present invention as it is shown in the figures, and as it will typically be used. The terms should not be understood to be otherwise limiting, but rather are used to distinguish various portions of the tool or blade member from one another, for ease of understanding.

In a typical use, blade member front edge 12 is forced under paint to be removed, by a worker who grips handle member 6. To facilitate this, the blade member front edge 12 includes a beveled scraper blade or knife blade 17 along the very front edge thereof, which comes to a relatively sharp edge.

Referring to FIG. 2, the beveled edge 17 extends generally completely along the front edge portion 12 of the blade member 5, between opposite front corner portions 18 and 19 thereof. The preferred scraper tool 1 according to the present invention includes pick or awl points extending generally laterally outwardly from each of the corner portions 18 and 19. In FIG. 2, these awl points are represented by reference numerals 21 and 22, respectively. The preferred awl points 21 and 22 are beveled analogously to beveled portion 17. These awl points 21 and 22 may be of a variety of shapes and sizes, depending upon the use contemplated. Generally, the awl points are used to dig into corners, cracks and crevices, to remove paint or the like therefrom.

The preferred awl points extend outwardly from a side edge of the blade member 5 a total of between about 0.1 and 0.25 inches. Also, preferably, the points include a side extending at an angle of about 30 and 60 degrees and preferably 45 degrees, to a center line of the tool 1. Referring to FIG. 2, the above-preferred dimensions mean that distance D is between about 0.10 and 0.25 inches, and angle A is between about 30 and 60 degrees, and is preferably about 45 degrees. This latter results from the fact that for the preferred embodiment of FIG. 2, the side edges 13 and 14 of the blade member 5 are substantially parallel to one another. Thus, the preferred tool 1 has a plane of symmetry passing through its center, generally along line 3—3 in FIG. 2.

Referring to FIGS. 1 and 2, the tool 1 includes first and second opposite side gusset members 26 and 27. One each of the gusset members 26 and 27 extends along one each of the blade member sides 13 and 14. In particular, gusset member 26 extends along side 13 and gusset member 27 extends along side 14. As is understood by reference to FIGS. 1 and 3, the gusset members 26 and 27 are substantially mirror images of one another, and taper toward the blade member upper surface 10 as the blade member front edge 12 is approached. The preferred gusset members 26 and 27 each include an upper ridge 30 and 31 which, for the preferred embodiment, are flat and coplanar.

Numerous advantages result from the presence and placement of the gusset members 26 and 27. First, the gusset members 26 and 27 reinforce blade member 5 against substantial undesired flexing, bending or breakage during use. Also, the gusset members 26 and 27 form sides of a trough 35 into which paint sludge or scrapings may be directed, during use of the tool 1. Further, as described below, the gusset members 26 and 27 help efficiently direct longitudinal force, applied by the handle member 6, toward the front edge 12 of the blade member 5. Also, the gusset members 26 and 27 form a backing to a curved scraper portion described below.

Referring again to FIGS. 1-3, the tool 1 includes a rear wall member 40. The rear wall member 40 extends between the side gusset members 26 and 27, forming a backstop to trough 35. Referring to FIG. 3, the rear wall member 40 provides a backstop or deflection point for paint sludge 41, shown in phantom lines, as it is forced into the trough 35.

The three-sided enclosed trough 35 provides numerous advantages. For example, the backstop 40 helps deflect paint scrapings or sludge away from a worker's hand. Thus, the scraping process is made relatively clean and the worker's hand is somewhat protected from being burned by chemicals in the paint remover. Further, rear wall member 40, in enclosing the trough 35, helps form a collection point for the scrapings or sludge for disposal. Also, rear wall member 40, by communicating between side gusset members 26 and 27, imparts overall strength and rigidity to the tool 1 structure.

As previously indicated, tool 1 includes a handle member 6, by which the tool 1 can be easily grasped and manipulated. The handle member 6 may be of a variety of designs, and may include decorative features or finger grip elements thereon. Further, company designs, logos and advertising indicia may be applied to, or be molded into, the handle member 6. The handle member of the preferred embodiment, having the general dimensions previously presented, is advantageous in that it is relatively easy and comfortable to tightly grip. This results from its relatively thick structure.

For the preferred embodiment, FIGS. 1-3, the handle member 6 extends rearwardly from the blade member rear portion 15, i.e., rearwardly from the rear wall member 40. Referring to FIG. 3, handle member 6 also extends at an acute angle B with respect to the plane of the planar blade member 5. Preferably, the angle B is between about 5 and 12 degrees, and most preferably between about 8 and 9 degrees. For the preferred embodiment, the handle 6 extends out of the plane of the blade member 5 in a direction corresponding to the blade member upper surface 10. In this manner, the blade member 6 can be grasped with a worker's fingers slipping partially therearound, and with the handle member 6 leaving room between a handle 6 and a surface being scraped for the worker's fingers. This facilitates ease of use of the tool 1, with a less likelihood for scraping of the worker's knuckles. It will be understood that the angle B need not necessarily be large enough to completely accommodate a worker's fingers, as the plane of the blade member 5 may be pulled somewhat out of the plane of the work surface, during use of the tool 1. Generally the preferred range of acute angles described facilitates use.

Referring to FIG. 2, the preferred handle member 6 includes an aperture 46 therein by which the tool 1 can be hung from a hook, for example at a work bench or positioned on a worker's utility belt.

The preferred handle member 6 tapers somewhat, i.e., becomes narrower as the blade member 5 is approached, the wide end 47 facilitating ease of grip. For the preferred embodiment, the handle member 6 includes an uppermost portion or surface 50. Preferably, surface 50 is coplanar with the ridges 30 and 31 of the side gusset members 26 and 27 respectively. Advantages are obtained from this arrangement as follows:

The upper side of the tool 1 which comprises upper surface 50 and ridges 30 and 31 is substantially planar. Thus, the tool 1 may be laid upon a flat surface or hung against a flat surface, by this upper side. As a result, the tool will be more stable when laid down or hung against a work bench. Also, the tool will not present projecting sharp edges when laid down or stored.

Further, longitudinal force applied to handle 6 and directed as indicated by arrow 53, FIG. 3, will in part be directed through the gusset members 26 and 27 toward the blade member front edge 12. This will help efficiently concentrate force where it is most needed, i.e., along the front edge of the tool 1. In the absence of the relatively linear cooperation of side gusset members 26 and 27 and handle member 6, the force may have a tendency toward bending of the blade member 5 or toward loss of some efficiency due to deflection of the force toward a pressing of the blade member 5 against the work surface being scraped. That is, increased friction to pushing along the work surface could result, without an increased leverage for scraping at the tool front edge.

Preferably, the tool includes curved scaper means, preferably concave scraper means, comprising a curved scraper blade to facilitate scraping of curved surfaces. Referring to FIGS. 1 and 2, the preferred embodiment of the present invention includes curved scaper blade means comprising first and second opposite concave curved scraper blades 56 and 57 for use in scraping paint from a curved surface, such as a painted rod or the like. Each curved scraper blade 56 and 57 includes a beveled outwardly projecting blade edge 60 and 61 and a curved side wall 62 and 63. The beveling facilitates scraping as it provides a relatively strong structure with a somewhat sharp edge. The radius of curvature of the curved blades 56 and 57 need not be the same and need not be constant throughout the complete extension of each curved blade. In the preferred embodiment, curved blades 56 and 57 are mirror images of one another.

Referring to FIG. 1, a particular advantage to the present invention is that curved side walls 62 and 63, formed from the gussets 26 and 27, and the rear wall member 40, each form a trough facilitating sludge removal and collection.

A transition portion 67 exists in the tool 1, where the handle member 6 engages the blade member 5. Referring to FIG. 2, at the transition portion 67 handle member 6 expands somewhat, forming an abutment against which a worker's hand can press during utilization of the tool 1. In the preferred embodiment, FIGS. 1 and 2, friction ribs 68 are positioned in the tool 1 along sides of the transition portion. A worker's hand can press against these friction ribs 68, with the ribs providing an easily engaged surface to inhibit slippage. The preferred friction ribs 65 are substantially vertical.

In FIG. 4 an alternate embodiment of the present invention is illustrated. The tool 70 illustrates in FIG. 4 generally includes all of the features previously described, i.e., a blade member 71, a handle member 72, a blade member front edge 73 with a beveled blade 74 thereon, a pair of awl members 75 and 76, a pair of side gussets members 77 and 78, a rear wall member 79, curved blades 80 and 81, transition portion 82 with friction ribs 83, and a handle member 72 extending at an angle to the blade member 71 in an analogous fashion to handle member 6 of tool 1. The only significant difference between tool 70 and tool 1 is that of the relative sizes between the handle member 72 and the blade member 71. In particular, for the embodiment of FIG. 4, the blade member 71 is narrower relative to the handle member 72, than it is for tool 1. From this it will be understood that a variety of relative sizes between the handle member and blade member may be selected. The ratio of widths, lengths, and thicknesses may easily be modified, in tools having the advantageous features described herein.

It is to be understood that while certain embodiments of the present invention have been illustrated and described, the invention is not to be limited to the specific forms or arrangements of parts described and shown.

What is claimed is:

1. A paint scraper tool comprising:

(a) a substantially planar blade member having upper and lower surfaces, a front edge, first and second opposite side edges, and a rear portion;
  (i) said blade member front edge having opposite corner portions, each of said corner portions including an awl point thereon; and
  (ii) said blade member front edge including a beveled scraper blade thereat;

(b) first and second side gusset members; one each of said side gusset members being positioned to extend along one each of said blade portion side edges;
  (i) said gusset members extending along said blade member upper surface; and
  (ii) said gusset members each tapering toward said blade member front edge, from said blade member rear portion;

(c) a rear wall member extending between said side gusset members and forming a trough therewith;

(d) a handle member engaging said blade member rear portion and extending rearwardly therefrom;

(i) said handle member extending at an acute angle with respect to said planar blade member; and (ii) said handle member extending out of a plane of said blade member in a direction corresponding to said blade member upper surface; and (e) at least one of said gusset members including an inwardly curved side wall portion with an outwardly projecting, concave blade edge having a radius lying in a plane substantially parallel to the blade member, the radius of the blade edge forming concave side blade means for use in scraping pain or the like from a curved surface.

2. The paint scraper tool according to claim 1 wherein said acute angel of extension of said handle member is between about 5° and 12°.

3. The pain scraper tool according to claim 1 wherein said entire tool comprises a piece of molded polymeric plastic material.

4. The pain scraper tool according to claim 1 wherein:

(a) each of said side gusset members has an upper ridge, said gusset member upper ridges being substantially coplanar with one another;

(b) said handle member has an upper surface portion substantially coplanar with said gusset member upper ridges;

(c) whereby said scraper tool may be hung substantially flat against a wall, or may be securely laid upon a substantially flat surface; and (d) whereby force transmitted longitudinally along said handle member and toward said blade front edge may in part be transmitted through said gusset members.

5. A scraper tool according to claim 1 including a transition portion between said handle member and said rear wall member; said transition portion having substantially vertical friction ribs therein, whereby secure gripping of said scraper tool is facilitated.

6. The pain scraper tool according to claim 1 wherein the tool is disposed between two spaced apart parallel planes, the spacing of the planes being substantially that of the thickness of the handle.

7. A pain scraper tool comprising:

(a) a substantially planar blade member having upper and lower surfaces, a front edge, first and second opposite side edges, and a rear portion;

(i) said blade member front edge having opposite corner portions, each of said corner portions including an awl point thereon; and (ii) said blade member front edge including a beveled scraper blade thereat;

(b) first and second side gusset members; one each of said side gusset members being positioned to extend along one each of said blade portion side edges;

(i) said gusset members extending along said blade member upper surface; and (ii) said gusset members each tapering toward said blade member front edge, from said blade member rear portion;

(c) a rear wall member extending between said side gusset members and forming a trough therewith;

8. The pain scraper tool according to claim 7 wherein:

(a) each of said side gusset members has an upper ridge, said gusset member upper ridges being substantially coplanar with one another;

(b) said handle member has an upper surface portion substantially coplanar with said gusset member upper ridges;

(c) whereby said scraper tool may be hung substantially flat against a wall, or may be securely laid upon a substantially flat surface; and (d) whereby force transmitted longitudinally along said handle member and toward said blade front edge may in part be transmitted through said gusset members.

* * * * *

UNITED STATES PATENT AND TRADEMARK OFFICE
CERTIFICATE OF CORRECTION

PATENT NO. : 5,095,573

DATED : 3/17/92

INVENTOR(S) : Henke et al.

It is certified that error appears in the above-identified patent and that said Letters Patent is hereby corrected as shown below:

In Column 9, line 11, in Claim 1, "pain" should read --paint--.
In Column 9, line 15, in Claim 2, "angel" should read --angle--.
In Column 9, line 17, in Claim 3, "pain" should read --paint--.
In Column 9, line 20, in Claim 4, "pain" should read --paint--.
In Column 10, line 5, in Claim 7, "pain" should read --paint--.
In Column 10, line 1, in Claim 6, "pain" should read --paint--.
In Column 10, line 24, in Claim 7, after the word "therewith;", insert the following:

--(d) a handle member engaging said blade member rear portion and extending rearwardly therefrom:

(i) said handle member extending at an acute angle of between about 5° and 12° with respect to said planar blade member; and (ii) said handle member extending out of a plane of said blade member in a direction corresponding to said blade member upper surface; and (e) said scraper tool comprising a simple piece od molded polymeric plastic material;

(f) at least one of said gusset members including an inwardly curved side wall portion with an outwardly projecting, concave blade edge having a radius lying in a plane substantially parallel to the blade member, the radius of the blade edge forming concave side blade means for use in scraping paint or the like from a curved surface;

(g) the tool being of one piece and being disposed between two spaced apart parallel planes, the spacing of the planes being substantially the thickness of the handle.--

UNITED STATES PATENT AND TRADEMARK OFFICE

CERTIFICATE OF CORRECTION

PATENT NO. : 5,095,573

DATED : 3/17/92

INVENTOR(S) : Henke et al.

It is certified that error appears in the above-indentified patent and that said Letters Patent is hereby corrected as shown below:

Col. 10, line 25, in claim 8, "pain" should read —paint—.

Signed and Sealed this

Twenty-fifth Day of April, 1995

Bruce Lehman

*Attest:*

BRUCE LEHMAN

*Attesting Officer*

*Commissioner of Patents and Trademarks*